United States Patent [19]

Willcox

[11] Patent Number: 4,516,136

[45] Date of Patent: May 7, 1985

[54] THERMAL PRINT HEAD

[75] Inventor: Charles R. Willcox, Buffalo Grove, Ill.

[73] Assignee: AT&T Teletype Corporation, Skokie, Ill.

[21] Appl. No.: 508,315

[22] Filed: Jun. 27, 1983

[51] Int. Cl.[3] ..... H05B 1/00

[52] U.S. Cl. ..... 346/76 PH; 219/543

[58] Field of Search ..... 346/76 PH, 76 R; 219/216 PH, 216 R, 543; 400/120; 338/307, 309, 306, 308

[56] References Cited

U.S. PATENT DOCUMENTS 3,609,294 10/1969 Cady, Jr. et al. ..... 219/543

4,034,187 7/1977 Tomioka et al. ..... 346/76 PH 4,176,272 11/1979 Powers ..... 219/216 PH

*Primary Examiner*—E. A. Goldberg

*Assistant Examiner*—Arthur G. Evans

*Attorney, Agent, or Firm*—W. K. Serp

[57] ABSTRACT

A thermal print head 10 with a support surface 12 having first and second intersecting axes 14, and 16 is shown. A logic unit in the form of a shift register 50 and driver transistor 20 controlled by the shift register 50 are along the second axis 16. A heater resistor 22 is also positioned along the first axis 14 adjacent an end of the driver transistor 20. Spaced first and second power busses are 24, 32 are positioned parallel to the second axis 16 and are connected to the heater resistor 22 and the driver transistor 20. A plurality of parallel conductors 40 are parallel to the second axis 16 and supply address and gate signals to the shift register 50.

5 Claims, 3 Drawing Figures

THERMAL PRINT HEAD

DESCRIPTION

1. Technical Field

This invention relates to a thermal print head.

2. Background Art

The prior art includes an integrated circuit print head across which thermally sensitive paper is drawn. Portions of the print head are selectively elevated in temperature to initiate a chemical reaction to produce desired patterns of visible indicia on the paper.

High speed, reliable printing requires that the heated portions of the print head be rapidly elevated to a relatively high temperature and quickly cooled. Since the paper is drawn rapidly across the print head in contact with the print head, wear is an important consideration. Any irregularities in the surface of the print head will cause surface wear.

DISCLOSURE OF THE INVENTION

In accordance with this invention, an apparatus for producing indicia on thermally sensitive paper includes a planar substrate which provides a support surface having first and second intersecting axes. A logic unit is included for receiving and storing input signals, including signals representative of indicia to be produced on the paper. A plurality of parallel conductors which are connected to the logic unit and are positioned substantially parallel to the second axis supply data to the logic unit. A driver transistor having a control element is connected to the logic unit. The driver transistor is controlled by output signals from the logic unit. A power source has a first and a second conductive buss. A heater resistor is connected to the output of the driver transistor so that the driver transistor, in response to signals from the logic unit, provides a low impedance path through the heater resistor between the busses. The first buss is adjacent to and extends along the heater resistors in a line parallel to the second axis. The second buss is adjacent to and extends along the driver transistors and is connected to an input of each of the driver transistors.

Preferably, a plurality of logic units are positioned consecutively along a line parallel to the second axis; and a plurality of driver transistors are consecutively positioned along a line substantially parallel to the second axis. A plurality of heater resistors are positioned consecutively along a line substantially parallel to the second axis.

THE DRAWINGS

DETAILED DESCRIPTION

Figure 1:
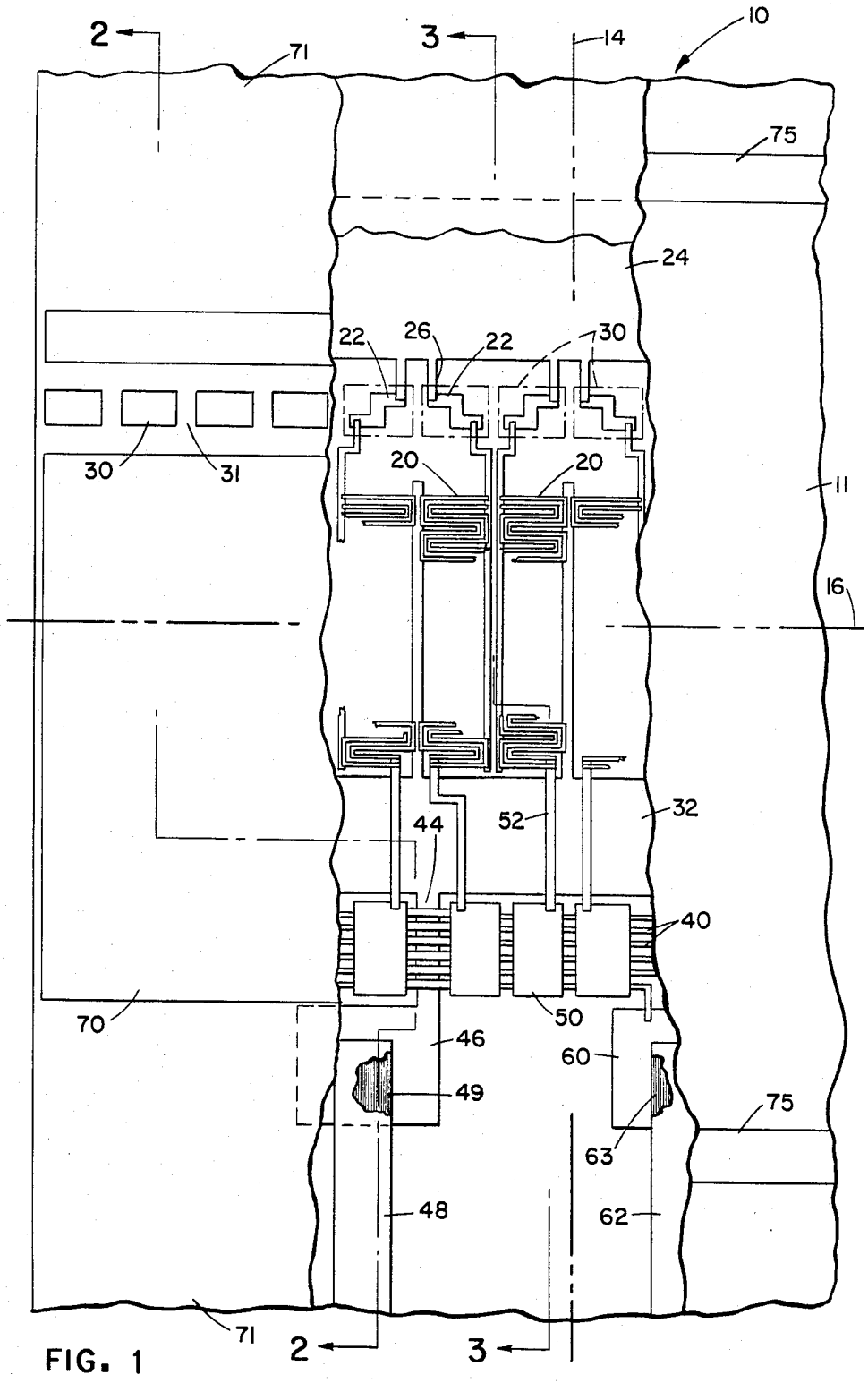
FIG. 1 is a plan view of a portion of an integrated circuit including certain features of this invention.
Figure 2:
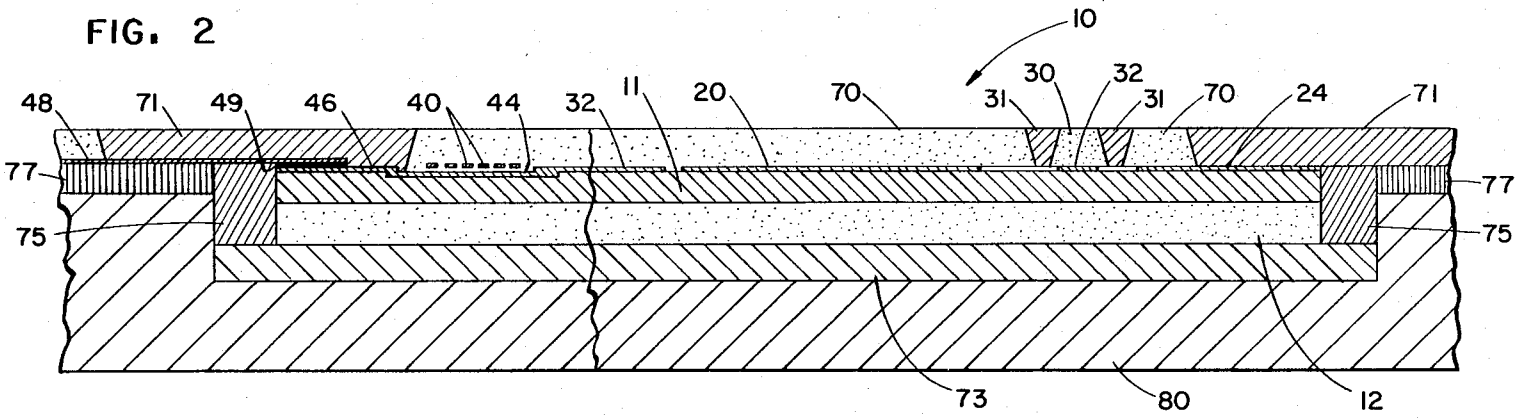
FIG. 2 is a sectional view taken along the line 2—2 of FIG. 1.
Figure 3:
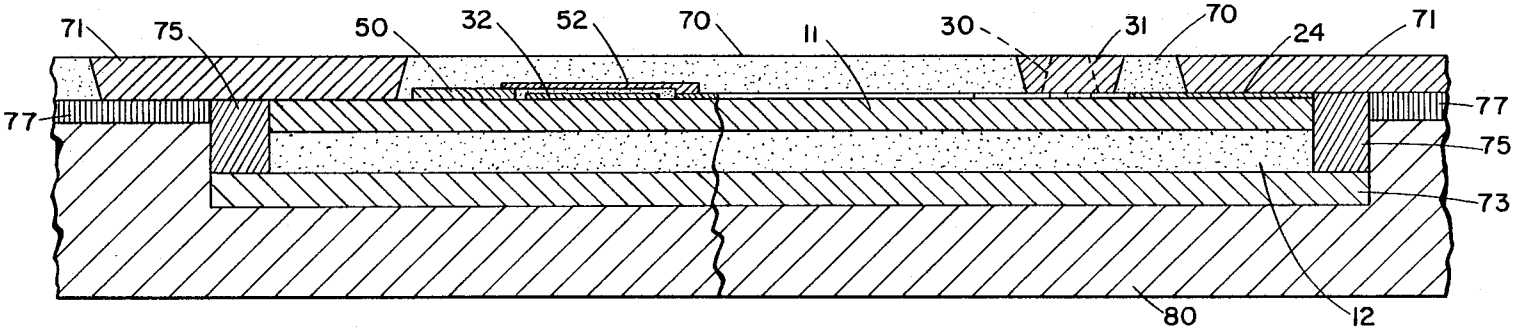
FIG. 3 is a sectional view taken along the line 3—3 of FIG. 1.

As shown in FIGS. 2 and 3, the circuit components of a thermal print head 10 are located upon an adhesive layer 11 which is supported by a generally flat silicon substrate 12. Elements of the print head 10 are implemented in MOS technology. In describing the print head 10, it is convenient to designate first and second intersecting axes 14 and 16 (FIG. 1) and to describe the various circuit components as being oriented generally along or parallel to one of the axes 14 and 16. A plurality of high current low impedance MOS driver transistors 20 are positioned along the second axis 16. The transistors 20 are relatively large so as to provide a low impedance current path. Each heater resistor 22 is associated with and is mounted adjacent to a corresponding one of the transistors 20.

The heater resistors 22 are consecutively positioned along a line parallel to the second axis 16. One terminal of each transistor 20 is connected to one end of its respective heater resistor 22 and the remaining terminal of the heater resistor 22 is connected to a power source including a first buss 24 by a conductive link 26. Each transistor 20 and its corresponding heater resistor 22 comprise a print cell 27. In one implementation, a plurality of such print cells 27 were arranged in a side by side relation in a single integrated circuit having a length of approximately one inch. The width of the aforementioned integrated circuit was approximately one-eighth of an inch. Several such integrated circuits may be positioned in line to accommodate a desired print area. The first buss 24 extends along a line parallel to the second axis 16 and supplies one polarity of a power source to each of the heater resistors 22. As shown, the driver transistors 20 and heater resistors 22 are arranged in pairs positioned in a side by side relationship.

Positioned on each heater resistor 22 is a rectangularly shaped plate 30 of silicon which is in intimate thermal contact with its associated heater resistor 22. The silicon plate 30 is thermally isolated from the other circuit components by an adhesive filter 31 (FIG. 2). The remaining electrode of the driver transistor 20 is connected to a second buss 32 which provides the power supply return. The second buss 32 extends along a line parallel to the second axis 16 and is adjacent the lower end of the driver transistor 20.

As illustrated in FIG. 1, extending along a line parallel to the second axis 16 are a plurality of parallel conductors 40 carrying power, clock, enable and data signals. The conductors 40 are insulated from and pass over a conductor 44 which connects the return buss 32 to a connection pad 46. An external lead 48 is attached to the connection pad 46 by conductive material 49 (e.g. solder). Positioned at spaced intervals along the parallel conductors 40 are logic units in the form of shift registers 50. The shift registers 50 are connected to the conductors 40 and are responsive to the signals thereon with the output of each shift register 50 being connected to its associated driver transistor 20 by a gate lead 52. The gate lead 52 passes over the ground buss 32 and is isolated therefrom. Each of the parallel conductors 40 is terminated at a conductive pad such as pad 60 which is connected to an external lead 62 by electrically conductive material 63. The remaining conductors 40 are terminated in a similar manner. It should be noted that the return buss 32 (ground) is positioned between the signal carrying conductors 40, their associated shift registers 50 and the high current carrying components of the circuit i.e. the drive transistors 20 and heater resistors 22. With this particular arrangement, the buss 32 effectively shields the input signal circuitry from noise generated by the high current, output circuitry.

As illustrated in FIGS. 2 and 3, the circuit components of the print head 10 are secured by the adhesive 11 to the silicon carrier substrate 12 which provides a rigid support base. The various elements illustrated in FIGS.

2 and 3 are not illustrated with relative dimensions but have been shown with selected elements exaggerated to more clearly show certain features of the embodiment. Silicon sections 70 are placed on the surface ofthe circuit components. The sections seal the circuitry from the environment. Placed between the silicon sections 70 and the heater plates 30 is adhesive 71. The adhesive 71 fills the recesses between the plates 30 resulting in a uniform surface. The silicon substrate 12 is positioned in the cavity of a carrier 80 of electrical insulating material. Thermally conductive material 73 provides a heat sink for the integrated circuitry. The cavity formed by the carrier 80 is also covered over certain portions with electrically insulating material 75 and 77. Several suitable methods for fabricating the print head 10 in accordance with current technologies are known in the art. A suitable method for fabricating such a print head is described in copending U.S. Patent Application entitled "A Method for Manufacturing an Integrated Circuit Device for a Thermal Printer" by R. Christian et al., having a common assignee with this application and filed simultaneously herewith.

Although this invention has been particularly shown and described in connection with an illustrated embodiment, it will be understood that various changes in form and detail may be made without departing from the spirit and scope of the invention as set forth in the following claims.

What is claimed is:

1. A thermal print head (10) for producing indicia on thermally sensitive paper, including a planar substrate (12) providing a support surface, the support surface having a first axis (14) and a second axis (16) generally perpendicular to the first axis (14), comprising:

a plurality of logic units (50) for receiving and storing input signals including signals representative of indicia to be produced on the paper, said logic units being positioned consecutively along a line parallel to said second axis (16);

a plurality of parallel conductors (40) connected to said logic unit and substantially parallel to said second axis (16) for supplying data to said logic unit (50);

a plurality of driver transistors (20), each of which includes a control element connected to one of said logic units and controlled by output signals from said logic units (50), said driver transistors (20) being positioned consecutively along a line parallel to said second axis (16);

a power source including first and secnd conductive busses (24, 32);

a plurality of heater resistors (22) connected to the output of said driver transistor (20), said driver transistor in response to said signals of said logic unit (50) provides a low impedance path through said heater resistor (22) between said busses (24, 32), said heater resistor (22) being positioned consecutively along a line substantially parallel to said second axis (14);

said first buss (24) being adjacent to and extending along said heater resistors (22) in a line parallel to said second axis (16), said second buss (32) being adjacent to and extending along said driver transistors (20) and connected to each of said driver transistors (20);

said second buss (32) is positioned between said logic units (50) and said driver transistors (20); and the control electrodes of said driver transistors (20) are connected to their respective logic units (50) by corresponding conductor (52) insulated from and passing over said second buss (32).

2. A thermal print head for producing indicia on thermally sensitive paper comprising:

a planar substrate providing a support surface, the support surface having length and width;

first and second spaced apart parallel conductive busses disposed along the length of said body for distributing respectively first and second potentials;

a plurality of printing cells disposed along the length of said body between said first and second busses, each cell comprising a heater resistor and a conrol transistor serially connected between said first and second busses;

means for thermally isolating said heater resistor from said control transistor;

means for thermally isolating said resistors of adjacent printing cells from one and another;

means for controlling said control transistors including logic control circuitry disposed along the length of said body and separated from said control transistors by said second buss; and said logic control circuitry comprising input terminals for receiving signals for selectively controlling said control transistors and a plurality of output conductors equal in number to said plurality of printing cells and connected to respective cells for controlling said serial connections between said first and second busses.

3. The thermal print head of claim 1 which further includes a plurality of individual heat conductive plates (30) positioned over corresponding ones of said heater resistors (22) for conducting heat from the respective heater resistor (22) to the thermally sensitive paper.

4. The thermal print head of claim 3 wherein said plates 30 are thermally insulated from each other by adhesive material (31).

5. The thermal print head of claim 2 wherein: said control transistors, said logic control circuitry and said heater resistors are of MOS (Meal Oxide Silicon) fabrication.

* * * * *